US009498671B1

(12) United States Patent
Softky

(10) Patent No.: US 9,498,671 B1
(45) Date of Patent: Nov. 22, 2016

(54) TREADMILL WORK SURFACE

(76) Inventor: William Russell Softky, Menlo Park, CA (US)

( * ) Notice: Subject to any disclaimer, the term of this patent is extended or adjusted under 35 U.S.C. 154(b) by 0 days.

(21) Appl. No.: 13/428,990

(22) Filed: Mar. 23, 2012

Related U.S. Application Data

(60) Provisional application No. 61/465,834, filed on Mar. 25, 2011.

(51) Int. Cl.
*A63B 22/02* (2006.01)

(52) U.S. Cl.
CPC ..... *A63B 22/02* (2013.01); *A47B 2220/06* (2013.01); *A63B 2210/50* (2013.01)

(58) Field of Classification Search
CPC .. A63B 71/02; A63B 71/0622; A63B 22/02; A47B 3/00; A47B 3/087; A47B 3/10; A47B 83/00; A61G 13/105; A61G 13/009
USPC ..... 248/150, 152, 165, 166, 168, 169, 170, 248/171, 172; 108/166–169, 171–174, 178, 108/42–45
See application file for complete search history.

(56) References Cited

U.S. PATENT DOCUMENTS 134,149 A * 12/1872 King ..... A47B 3/087 108/132
148,945 A * 3/1874 Francis ..... A47B 3/00 108/174
4,833,998 A * 5/1989 Everett ..... A47B 3/00 108/132
6,705,234 B1 * 3/2004 Miller ..... A47B 3/087 108/115
RE39,180 E * 7/2006 Colassi ..... A63B 22/0214 482/54
7,780,578 B2 * 8/2010 Packham ..... A63B 22/02 482/4
2003/0168558 A1 * 9/2003 Mallory ..... F16M 11/38 248/163.1
2006/0247109 A1 * 11/2006 Powell ..... A63B 71/0622 482/148
2008/0234111 A1 * 9/2008 Packham ..... A63B 22/02 482/54
2009/0272299 A1 * 11/2009 Rios ..... A47B 3/083 108/36
2010/0183814 A1 * 7/2010 Rios et al. ..... 427/387
2012/0264573 A1 * 10/2012 Hsu ..... A63B 69/0064 482/54
2013/0116095 A1 * 5/2013 Hsieh ..... A63B 22/02 482/54
2016/0192771 A1 * 7/2016 Hoff ..... A47B 3/06 248/165

* cited by examiner

*Primary Examiner* — Jonathan Liu
*Assistant Examiner* — Muhammad Ijaz
(74) *Attorney, Agent, or Firm* — Patent Law Works LLP

(57) ABSTRACT

An apparatus for allowing a person to operate a computer while walking on a treadmill with handrails is disclosed. In one embodiment, the apparatus comprises a rigid first member, a rigid second member and a joint connecting a first end of the first member to a first end of the second member. The connection has at least two positions including a first position and a second position. The first position aligns the first and second members into a first configuration for providing a work surface wherein a first surface of the first member is coplanar to a first surface of the second member to create the work surface for supporting a computing device and a user's wrists, the work surface rigid enough to support the computer device and the user's wrists. The second position aligns the first member and the second member into a second configuration for transportation.

16 Claims, 5 Drawing Sheets

TREADMILL WORK SURFACE

CROSS REFERENCE TO RELATED APPLICATIONS

This application claims the benefit under 35 U.S.C. §119 (e) of U.S. Provisional Application No. 61/465,834, entitled "Portable Machine for Allowing a Person to Operate a Computer while Walking on a Freestanding Treadmill" filed Mar. 25, 2011, the entire contents of which are herein incorporated by reference.

BACKGROUND

1. Field of the Invention

The specification relates to an apparatus for providing a work surface. In particular, the specification relates to an apparatus for providing a work surface on a treadmill with hand rails.

2. Description of the Related Art

Research has shown that sitting for hours carries serious health risks. One possible solution is to spend part of a workday doing deskwork (e.g. computer operation) while walking slowly on a treadmill. Current systems rely on a single rigid board resting across a treadmill's handrails.

Current systems are problematic. Since people often use treadmills at a gym, a first problem with the current systems is that they are bulky and lack portability. Since treadmills come in various configurations, a second problem with current systems is a lack of compatibility with the various configurations. Since many treadmill handrails are below elbow height resulting in wrist dorsiflexion while typing, which places stress on both the carpal tunnel and the arm tendons, a third problem with current systems is ergonomics.

SUMMARY

The specification overcomes the deficiencies and limitations of the prior art at least in part by providing an apparatus for providing a work surface on a treadmill with handrails.

In some examples, the specification describes an apparatus for providing a work surface on a treadmill with handrails. In one example, the apparatus comprises a rigid first member, a rigid second member and a joint connecting a first end of the first member to a first end of the second member. The connection has at least two positions including a first position and a second position. The first position aligns the first and second members into a first configuration for providing a work surface wherein a first surface of the first member is coplanar to a first surface of the second member to create the work surface for supporting a computing device and a user's wrists, the work surface rigid enough to support the computer device and the user's wrists. The second position aligns the first member and the second member into a second configuration for transportation.

In some embodiments, the apparatus further includes one or more of the following features. The joint comprises a hinge connected to the first member and the second member opposite the first surfaces. The hinge rotates between the second configuration at zero degrees and the first configuration at one hundred and eighty degrees. A first hinge offset at the first end of the first member opposite the first surface connected to the hinge, and a second hinge offset at the first end of the second member opposite the first surface connected to the hinge. The hinge offsets having a height for allowing the first member to align parallel with the second member in the second configuration. One or more of the hinge offset elongated perpendicular to the joint, the elongation increasing the rigidity of one or more of the first member and the second member while not increasing the thickness of the apparatus in the second configuration. An anti-slip surface at a contact point between the apparatus and a treadmill handrail for preventing the work surface from slipping relative to the handrails. A collapsible support member for supporting the first member and the second member in the first configuration above the treadmill handrails. A first side-support member connected at a first end to a second end of the first member by a first support hinge, and a second side-support member connected at a first end to a second end of the first member by a second support hinge. The side-supports at opposite ends of the work surface and extending from the surface opposite the work surface at a splay angle between zero and one hundred and eighty degrees, wherein the splay angle is zero in the second configuration and between ninety degrees and one hundred and eighty degrees in the first configuration. The hinged diagonal side supports each contacting a treadmill handrail and supporting the work surface. A means of adjusting the splay-angle of said side supports in the first configuration. One or more markings for visually indicate the splay angle of the side supports. Adjusting the splay angle in the first configuration adjusts the height of the work surface relative to the height of the treadmill handrails. Adjusting the splay angle in the first configuration adjusts the point of contact between the side support and the treadmill handrail for accommodating different handrail spans. A flexible member attached to the support member at a first end and the first member at a second end and whose effective length is adjustable, the effective length determining the splay-angle of the support member in the first configuration. A flexible member attached to the support member at a first end and the first member at a second end and whose effective length is fixed, the splay-angle of one or more side supports in the first configuration determined based at least in part on a selected anchoring point 42 of the flexible member, one or more of the support member, the first member and the second member comprising a plurality of anchoring points 42. A rigid member attached to the support member at a first end and the first member at a second end for adjusting the support member to a selected splay angle in the first configuration.

The features and advantages described herein are not all-inclusive and many additional features and advantages will be apparent in view of the figures and description. Moreover, it should be noted that the language used in the specification has been principally selected for readability and instructional purposes, and not to limit the scope of the subject matter disclosed herein.

BRIEF DESCRIPTION OF THE DRAWINGS

The embodiments are illustrated by way of example, and not by way of limitation in the figures of the accompanying drawings in which like reference numerals are used to refer to similar elements. Moreover, aspects may be exaggerated or enlarged to facilitate an understanding of the embodiments.

DETAILED DESCRIPTION

An apparatus for providing a work surface on a treadmill with handrails is described. In the following description, for purposes of explanation, numerous specific details are set forth in order to provide a thorough understanding of the embodiments. It will be apparent, however, to one skilled in the art that the embodiments can be practiced without these specific details.

Reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
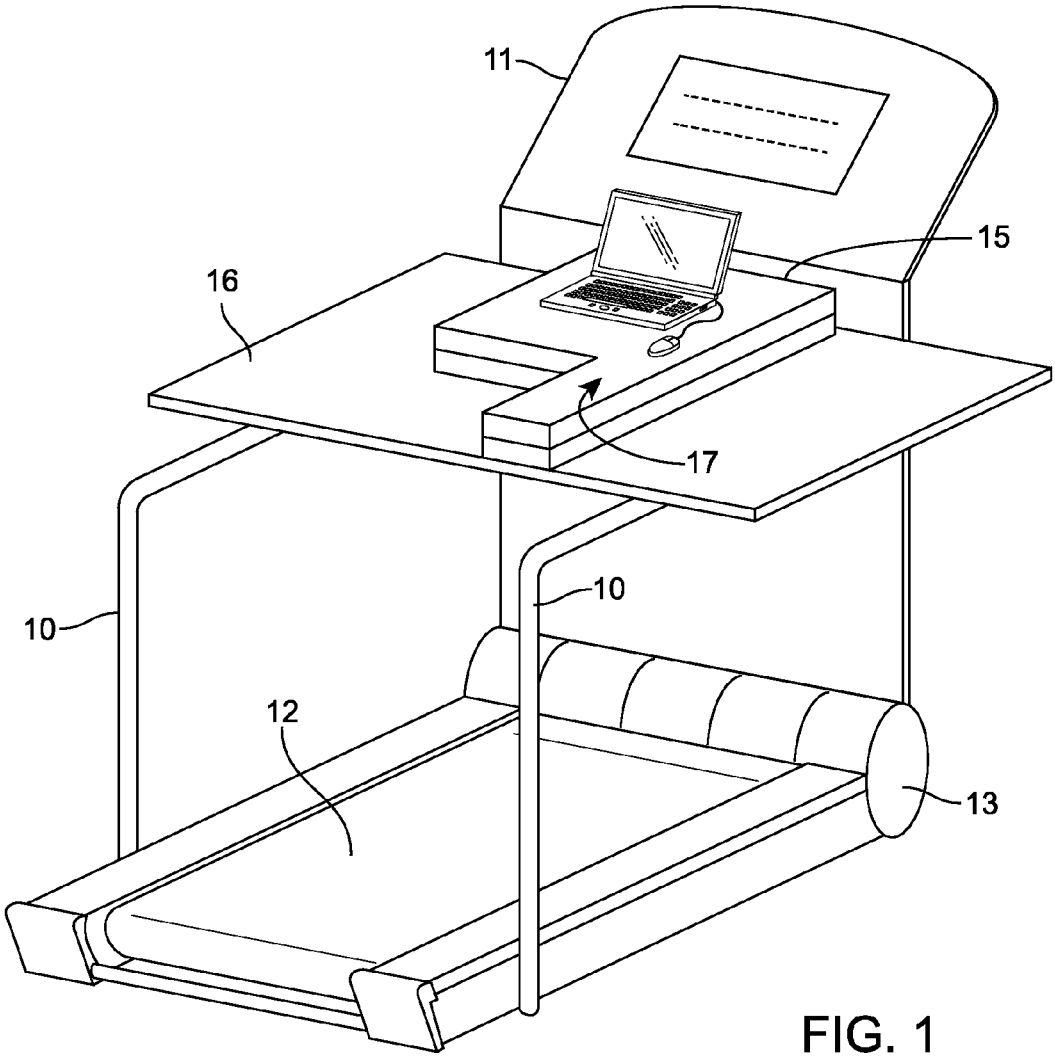
FIG. 1 is a perspective view of an apparatus for providing a work surface on a treadmill with handrails according to one embodiment.

FIG. 1 is a perspective view of a non-foldable work surface with a boosting platform mounted on a treadmill according to one embodiment. In one embodiment, the treadmill is a freestanding tread mill. For example, the treadmill comprises motor assembly 13, a moving deck 12, a console 11 and handrails 10. It will be recognized that the preceding is are merely examples of treadmill components and that a treadmill may comprise other and/or different components.

Existing treadmill desks consist of a single rigid panel having fixed dimensions sufficient to span the handrails 10 of some models of treadmill. One failing of the existing treadmill desks is that the work surface created is the approximate height of handrails. The height of the handrails for many individuals is too low to provide ergonomic and comfortable positioning of the arms and wrist for operating a computing device, for example, a laptop's keyboard and/or a mouse.

In one embodiment, the apparatus for providing a work surface on a treadmill with handrails comprises a boosting platform. In one such embodiment, the apparatus for providing a work surface on a treadmill with handrails is compatible with existing treadmill desks. For example, an existing treadmill desk 16 rests across the handrails 10, and the boosting platform 15 rests upon the existing treadmill desk providing an elevated work surface upon which a computing device may rest.

In one embodiment, the boosting platform has a height such that a computing device resting on top of the boosting platform is placed at an ergonomic and comfortable height for using the computing device. For example, the boosting platform has a height that, when used on a treadmill with the most common height handrails, places a computing device at an ergonomic height for an average height individual. In another example, the boosting platform has an adjustable height (e.g. one or more adjustable height feet).

In one embodiment, the boosting platform comprises a mouse and wrist support 17. In one embodiment, the mouse and wrist support provides a surface for ergonomically using a mouse and for supporting and steadying a user's hand and forearm while walking on the treadmill deck 12 and using the mouse.

Figure 2:
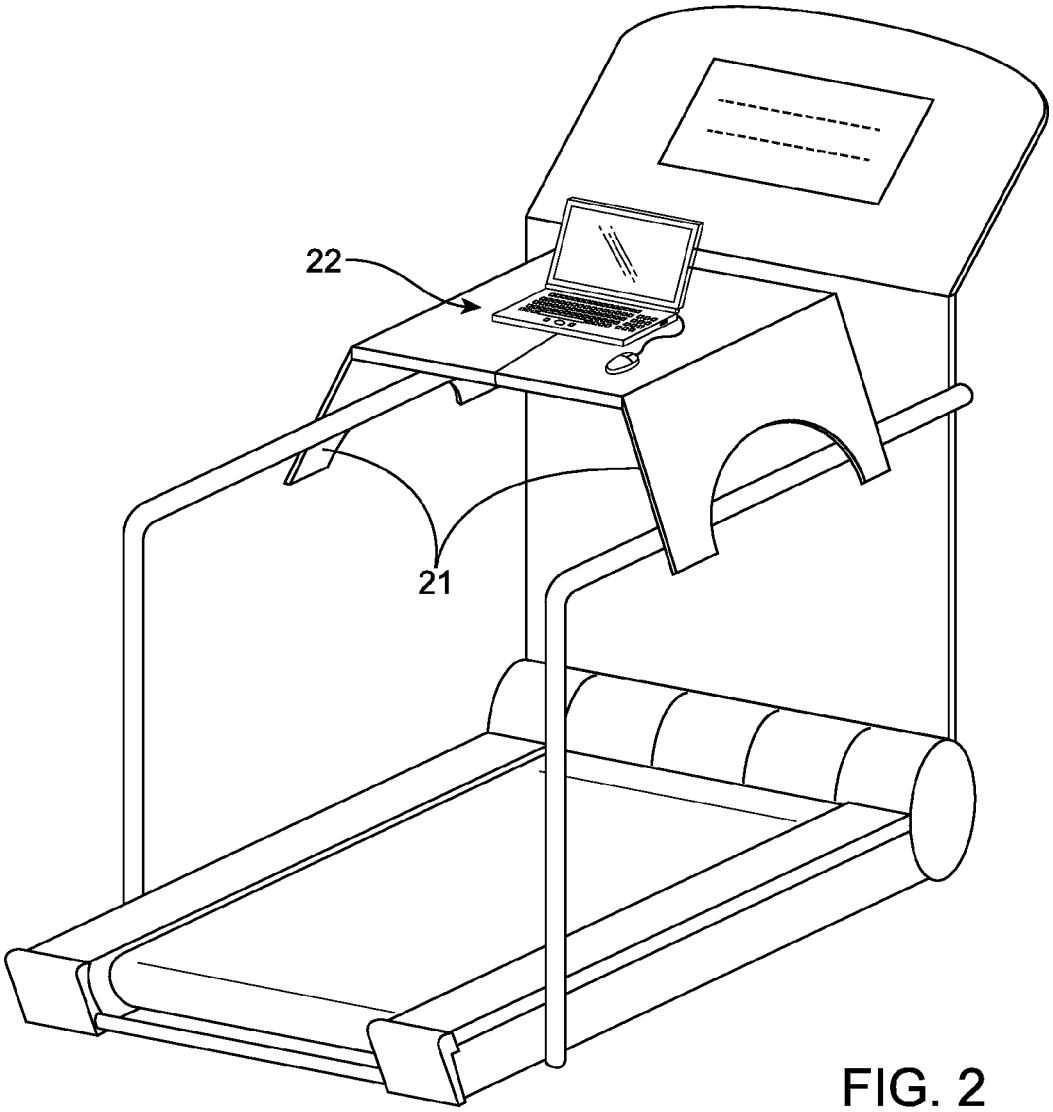
FIG. 2 is a perspective view of an apparatus for providing a work surface on a treadmill with handrails according to another embodiment.

FIG. 2 is a perspective view of one embodiment of an apparatus for providing a work surface on a treadmill with handrails according to one embodiment. Specifically, FIG. 2 illustrates one embodiment of a collapsible work surface comprising desktop members 22 mounted on and elevated above the handrails 10 of a treadmill by supporting members 21.

Figure 3:
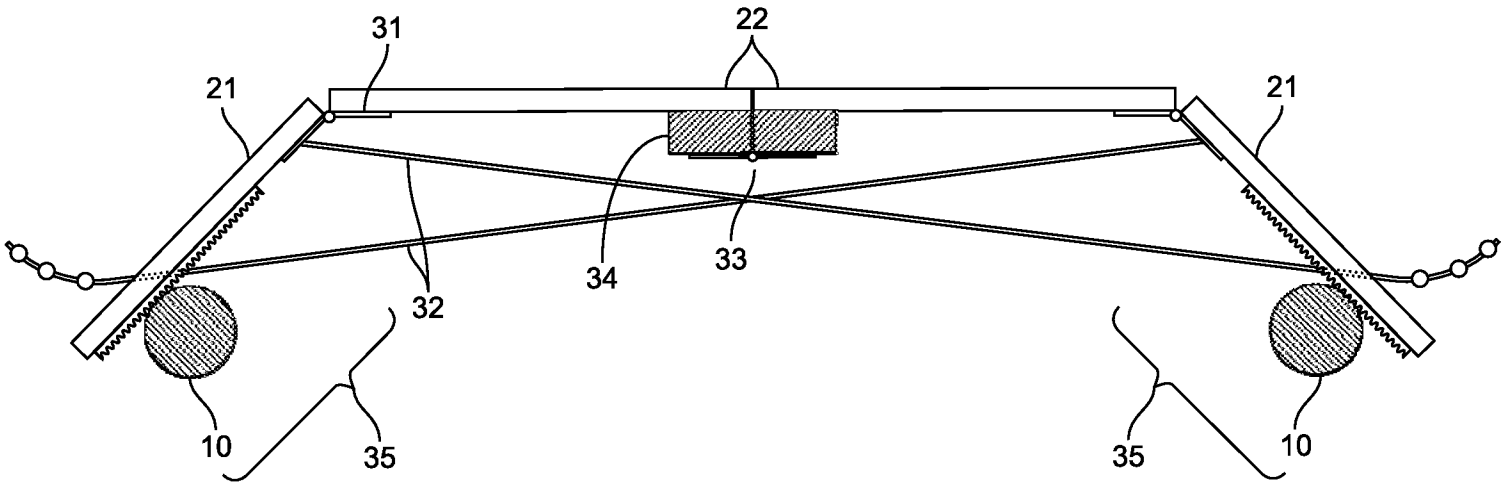
FIG. 3 is an elevation end-view of an apparatus for providing a work surface on a treadmill with handrails according to one embodiment.

The present embodiment provides advantages over existing treadmill desks. First, the apparatus of FIG. 2 provides an elevated work surface, which is more ergonomic and comfortable for using a computing device. Second, in some embodiments, the height of the desktop relative to the handrails 10 is adjustable. The height adjustment beneficially allows an individual to position the work surface at the most comfortable and ergonomic height for himself/herself regardless of the individual's proportions and the height of the handrails 10. For example, assume most individuals use a treadmill at a gym and that a gym has multiple treadmills of different makes or models with different distances between the handrail 10 and the deck 12. A work surface with a fixed, raised height may be more ergonomic than existing treadmill desks; however, the fixed, raised height could be slightly too high or too low depending on the make or model of the treadmill the individual uses at the gym. In one embodiment, the side supports may be adjusted by an individual to create an ergonomic work surface regardless of the distance between the handrail 10 and deck 12 and regardless of the individual's physical proportions. Third, since many individuals may use a treadmill at a gym, the ability to easily transport the work surface to and from the gym is desirable. In one embodiment, the apparatus can be collapsed into a compact, portable configuration for transportation. In one embodiment, the apparatus is collapsed by folding the desktop members 22 and support members into a second configuration that is more compact and portable. The first configuration is shown in FIGS. 2 and 3. The second configuration is discussed in reference to FIGS. 4 and 5.

In FIG. 3, the apparatus for providing a work surface on a treadmill with handrails is illustrated in a first configuration according to one embodiment. In the first configuration, the apparatus provides a work surface on a treadmill with handrails. As illustrated, the work surface comprises two rigid desktop members 22 connected by a center joint. The top surfaces of the two desktop members 22 are coplanar to each other in the first configuration providing a work surface. In one embodiment, the two rigid members have the same or approximately the same dimensions so that the joint is in the center, or approximate center, of the work surface in the first configuration. The joint has at least two positions. In a first position, the joint aligns the top surfaces of the two members of desktop 22 coplanar to each other as illustrated. In a second position, the joint enables a second, compact configuration for transportation, which is discussed in reference to FIGS. 4 and 5.

In one embodiment, the joint is a hinged joint including one or more center hinges 33. In one embodiment, the center hinge 33 is any kind of hinge with approximately 180-degree travel. Examples include but are not limited to long metal piano-hinges, integrally-molded thermoplastic hinges integrally molded into the rigid desktop members 22, separately interlocking features built into the edges of the desktop members 22, etc. As illustrated, the center hinge 33 is shown in the "open" position with the hinge's flanges approximately 180 degrees apart, which aligns the surfaces of the two rigid desktop members 22 to create a coplanar work surface.

In one embodiment, the one or more center hinges 33 are mounted on one or more hinge offsets 34. In one embodiment, a hinge offset 34 is located on each of the rigid desktop members 22 on the surface opposite that of the work surface at the end where the joint is located. In one embodiment, a hinge offsets is attached to the rigid desktop members. In another embodiment, a hinge offset is part of the rigid desktop members 22. For example, a offset may be molded, milled, extruded, etc. as part of the rigid desktop members 22. The hinge offset moves the joint's center of hinging a distance away from the work surface of the desktop members 22. The offset increases the strength of the joint in the first configuration because the shear forces pulling on the one or more hinges' mounting points decrease proportionally to the distance between the hinge and the work surface which is under compression. Therefore, in some embodiments, the offsets 34 decrease the forces on one or more of a hinge pin, hinge mounting hardware and glue potentially allowing for one or more of a lighter and more portable apparatus and/or less expensive manufacturing of the apparatus without sacrificing strength and durability of the joint.

In one embodiment, the apparatus comprises one or more collapsible support members 21. The members comprising the apparatus (e.g., two desktop 22 members and two support members 21) are constructed of any material strong and rigid enough to support the weight of a computer device and a human forearm. In one embodiment, the members are constructed of a rigid, lightweight material. Examples of rigid, lightweight materials include but are not limited to plywood, thermoplastic, etc. Additionally, the members may use structural features to save weight while maintaining rigidity including but not limited to a foam-core sandwich, a honeycomb-core sandwich, etc.

In one embodiment, the apparatus comprises two support members 21 each pivotally connected to a desktop member such that the support members 21 are on opposite sides of the work surface in the first configuration. A pivotal connection allows the splay angle of a side support to be adjusted. The adjustment of the splay angle beneficially allows the apparatus to span and rest on handrails 10 of different separations, for example, the range of separations corresponding to commercially available freestanding treadmills. Additionally, the adjustment of the splay angle adjusts the height of the work surface relative to the height of the hand rails 10 beneficially enabling an individual to set the work surface at an ergonomic and comfortable height. In one embodiment, the splay angle may be adjusted from nearly vertical (90 degrees) to nearly horizontal (180 degrees) in the first configuration and to horizontal again (0 degrees) in the second configuration.

In one embodiment, a pivotal connection comprises one or more support hinges 31. In one embodiment, the support hinge 31 is any kind of hinge with nearly 180-degree travel. Examples include but are not limited to long metal piano-hinges, integrally-molded thermoplastic hinges integrally molded into the support members 21, separately interlocking features built into the edges of the support members 21, etc. It will be realized that the center hinge 33 and support hinge 31 are not necessarily the same type of hinge. In one embodiment, the one or more support hinges 31 are subjected to less force than the center hinge; therefore, in one embodiment, one or more of a smaller hinge, a less robust hinge and no hinge offset is implemented at the support hinge 31.

In one embodiment, the splay angle of the support members is adjustable. In one embodiment, the splay angle is adjusted at least in part by one or more tension elements 32. A tension element 32 counteracts the compression experienced by a support hinge 31. For example, the downward-bearing load on the work surface tends to force the support hinges open as the hinge joint is compressed and can be counteracted by tension (e.g. via a tension element 32). Since a mechanical truss is stronger when its points of compression and tension are far apart, in one embodiment, the tension element 32 stretches diagonally from two points spaced away from the support hinge 31 itself. For example, in one embodiment, the tension element 32 forms the third side of the triangle where the first side of the triangle comprises at least a portion of the coplanar desktop members 22 and the second side of the triangle comprises at least a portion of a support member 21. In one embodiment, the apparatus comprises two support members each using a tension element 32. In one embodiment, the two tension elements 32 function independently from one another but may touch or interact with one another (e.g. where they cross in the middle).

In one embodiment, one or more tension elements 32 are rigid. For example, a tension element may be composed of the same rigid material(s) as one or more of the desktop members 22 and the support members 21 and may implement the same, or similar, structural features. In one embodiment, one or more tension elements 32 are flexible. In one embodiment, a tension element (32) may be composed of any flexible material with sufficient tensile strength to support the apparatus under load in the first configuration and sufficient flexibility to fit inside the desk in the portable second configuration which is discussed in reference to FIGS. 4 and 5. Examples of flexible tension element 32 materials including but are not limited to nylon cord, rope, wire, strap, ribbon, chain articulated hinged joints).

Figure 4A:
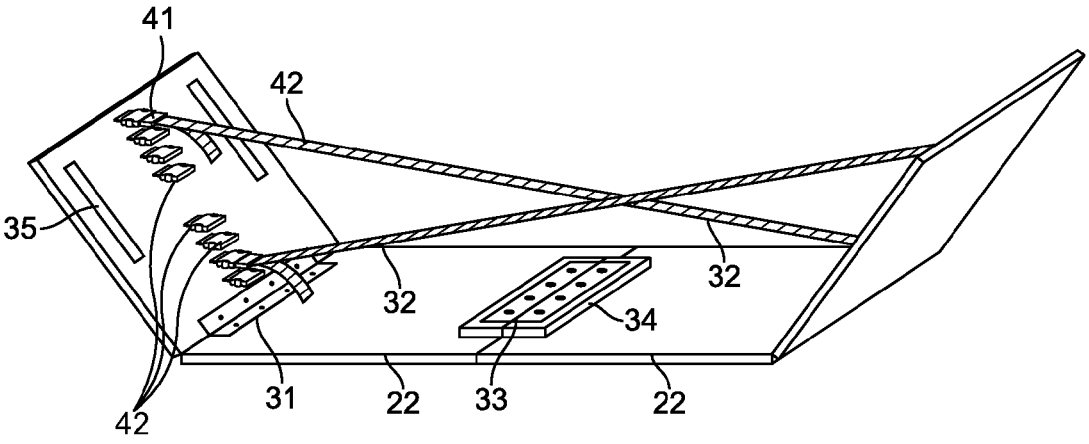
FIG. 4 is a perspective view of an apparatus for providing a work surface on a treadmill with handrails in various configurations according to one embodiment.
Figure 5A:
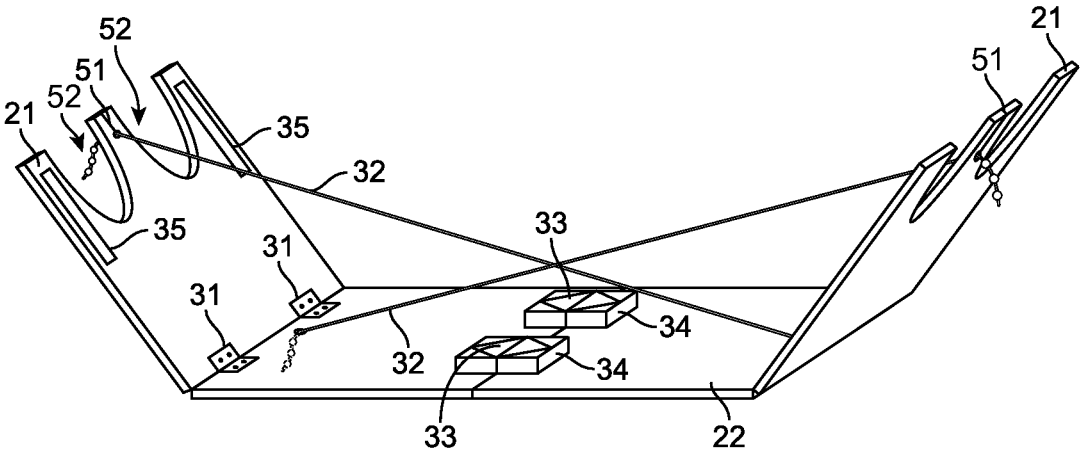
FIG. 5 is a perspective view of an apparatus for providing a work surface on a treadmill with handrails in various configurations according to another embodiment.

In one embodiment, the splay angle is adjusted at least in part by adjusting the effective length of a tension element 32. Referring to FIG. 4A, one example of adjusting the effective length of a tension element 32 is illustrated using a buckle 41 according to one embodiment. For example, a strap (i.e. a tension element 32) can be fed through the buckle 41 to increase or decrease the effective length of the tension element 32. Referring to FIG. 5A, another example of adjusting the effective length of a tension is illustrated using knots 53 in a cord (i.e. a tension element 32) which interface with an anchor (e.g., a slot 51) according to one embodiment. For example, the effective length is adjusted by adjusting which knot 53 is anchored in the slot 51; the knot being too large to be pulled through the slot 51 along the axis of tension. It will be recognized that the preceding are merely examples of tension elements 32 and means for adjusting the effective length of a tension element and that other examples exist.

In one embodiment, the splay angle is adjusted at least in part by adjusting the anchoring point 42 of a tension element 32. For example, referring again to FIG. 4A, the strap (i.e. tension member 32) may have a fixed length, but the buckle 41 can be anchored to one of a plurality of anchor points 42 on a support member (shown) and/or on a desktop member (not shown). It will be recognized that the preceding is merely an example of adjusting the splay angle of a support member by adjusting the anchoring point 42 of a tension member 32 and that other examples exist. Furthermore, it will be recognized that a tension member 32 is merely an example of a means for determining the splay angle of the support members and that other means exist. For example, in one embodiment, the splay angle is determined at least in part by one or more of a locking hinge and a locking pin.

In some embodiments, one or more markings indicating the splay angle are provided for expediting the adjustment of multiple support members 21 to the same splay angle, thereby eliminating the need to visually inspect and/or employ trial-and-error to obtain symmetric splay angles. The one or more markings may vary depending upon the embodiment. For example, referring again to FIG. 4A, assume the tension member 32 includes a fixed length strap and a buckle, in one embodiment, the markings may indicate the splay angle (e.g., in degrees) based at least in part on which anchor 42 the buckle 41 is attached to. Alternatively, the anchors 42 may be numbered or color coded so that an individual merely attaches the buckle 41 of each tension member 32 into its corresponding anchor 42 having the same number or color, respectively. In another example, assume the tension members 32 include an adjustable length strap and a buckle 41, in one embodiment, the adjustable length strap includes one or more strap markings 42, which may be used to determine the effective length and therefore the splay angle. For example, an individual lines up corresponding strap markings on each tension member 32. In yet another example, referring again to FIG. 5A, assume the tension members 32 include cords with identical knots 53, in one embodiment, the individual counts and ensures that the number of knots 53 visible outside the anchor slot 51 are the same for each tension member 32. In yet other examples, assume the splay angle is determined at least in part by one or more of a locking hinge and pins, in one embodiment, the markings include the indexes of one or more of the a pin, hole and slot to indicate the hinge-adjustment position. It will be recognized that the preceding are merely examples of one or more markings that indicate the splay angle and that other examples exist.

In one embodiment, one or more support members 21 include a means for anchoring the apparatus to a handrail 10. In one embodiment, the apparatus is mounted using friction, and a support member includes an anti-slip surface providing high friction. For example, the anti-slip surface may be one or more of structural (e.g. milling or molding a high friction texture into the support member 21), a surface treatment (e.g. applying a non-slip coating or gluing a rubber pad to the surface), etc. Referring again to FIG. 3, one embodiment of an anti-slip surface 35 is shown anchoring the side supports 21 to the handrails 10. The anti-slip surface 35 on the side supports 21 prevents the apparatus from moving relative to the handrails 10, thereby preventing the entire apparatus and computing device from moving or falling from one of the many forces subjected by typing, using the mouse, forearm motion and treadmill vibration. In another embodiment, the apparatus is mounted using a mechanism and the support member includes the mechanism. Examples of mechanisms include but are not limited to a safety strap, a hook, etc.

Figure 4B:
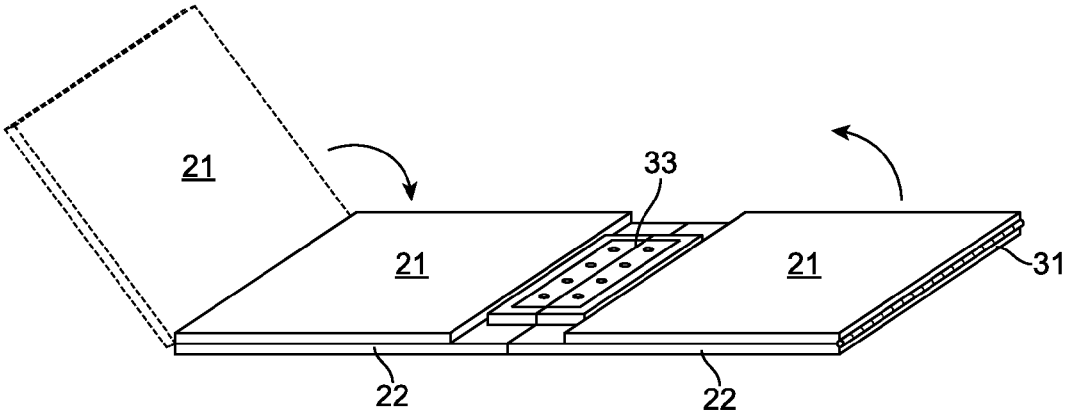
Figure 4C:
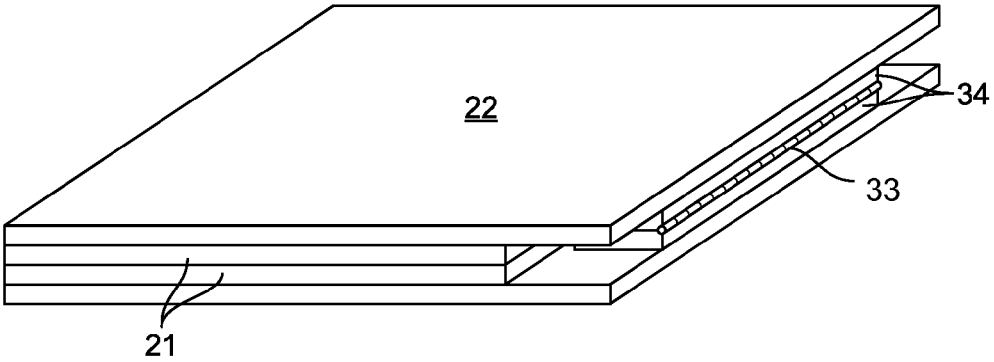

In some embodiments, the apparatus is capable of collapsing into a second configuration for portability. FIGS. 4A-C illustrate collapsing the apparatus from a first configuration to a second configuration according to one embodiment. Referring to FIG. 4A, a bottom view of the first configuration of the apparatus is illustrated according to one embodiment. The illustrated apparatus includes two desktop members 22, two support members 21 and two tension members 32. The desktop members 22 are connected by a center hinge 33 mounted on hinge offsets 34. The support members 21 each comprise anti-slip surfaces 35 and are each pivotally connected to a desktop member 22 by a support hinge 31. The tension members 32 in the illustrated embodiment are straps anchored to a support member 21 at one or more ends by a buckle 41. In one embodiment, the splay angle of a support member 21 is determined at least in part by the selected anchor 42. In another embodiment, the splay angle of the support member 21 is determined at least in part by the effective length of the strap. In one such embodiment, the strap has one or more markings 42 for indicating the splay angle of the support member.

Referring to FIG. 4B, a bottom view of an intermediary configuration between the first and second configuration is illustrated according to one embodiment. As illustrated, the support members 21 rotate about their pivotal connection (e.g. hinge 31) such that the splay angle between the desktop members 22 and the support members 21 is zero degrees or approximately zero degrees. In one embodiment, the support members 21 are shorter than the desktop members 22 (e.g. by the width of the hinge offset) so that the support members can fold flat (e.g. zero degrees) and do not contact the hinge offsets 34. The support members 32 and buckles 41 are not visible because they are nestled or sandwiched between the support members 21 and the desktop members 22.

Referring to FIG. 4C, a bottom view of the second configuration is illustrated according to one embodiment. As illustrated, from the intermediary configuration to the second configuration, the support members 21 and desktop members 22 rotate about the joint (e.g. center hinge 33) such that the angle between the flanges of the center hinge 33 is zero degrees or approximately zero degrees. In one embodiment, the desktop members 22 are approximately rectangular in external outline and the support members 21 and other components of the apparatus do not extend beyond the outline, providing a compact and portable profile. In one embodiment, the support members 21 and desktop members 22 are approximately rectangular in external outline, and the support members 21 and other components of the apparatus do not extend beyond the outline of the desktop members 22 providing a compact and portable profile. In one embodiment, the height of the hinge offsets 34 are such that the desktop members 22 are parallel or approximately parallel in the second configuration.

Figure 5B:
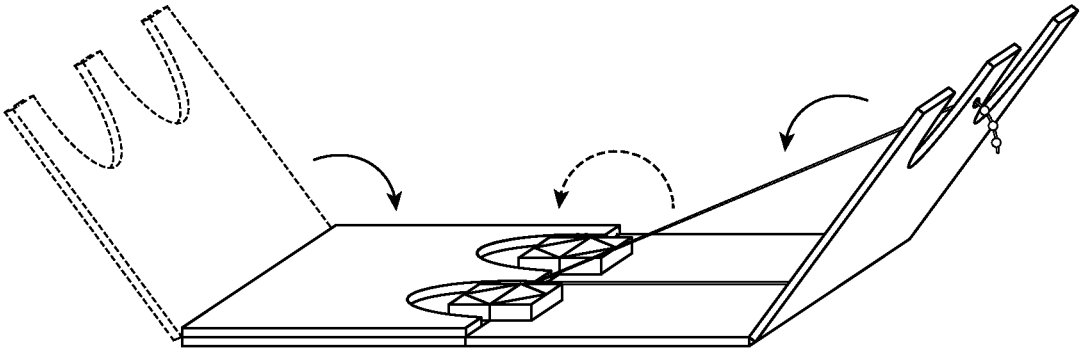
Figure 5C:
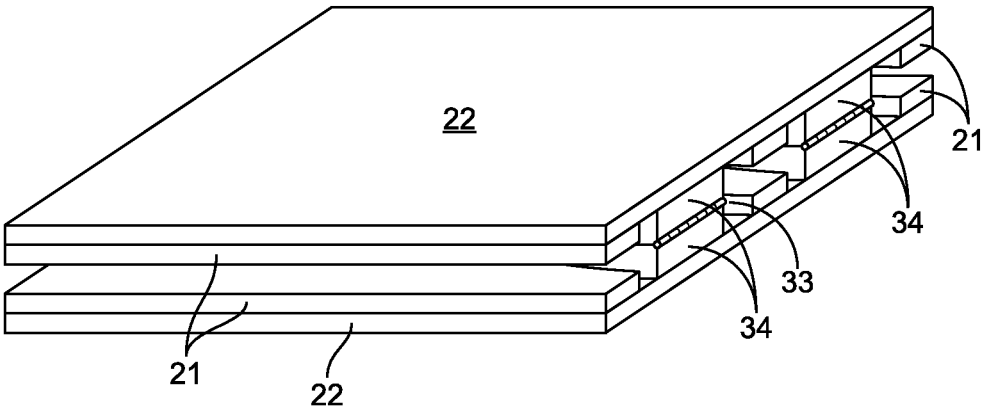

FIGS. 5A-C illustrate collapsing the apparatus from a first configuration to a second configuration according to another embodiment. Referring to FIG. 5A, a bottom view of the first configuration of the apparatus is illustrated according to one embodiment. The illustrated apparatus includes two desktop members 22, two support members 21 and two tension members 32. The desktop members 22 are connected by two center hinges 33 mounted on two pairs of hinge offsets 34. The support members 21 each comprise anti-slip surfaces 35, cutaways 52 and are each pivotally connected to a desktop member 22 by support hinges 31. The tension members 32 in the illustrated embodiment are cords each having a plurality of knots and anchored at one end to a support member 21 using slot 51. In one embodiment, the splay angle of a support member 21 is determined at least in part by the knot that interfaces with the slot 51.

Referring to FIG. 5B, a bottom view of an intermediary configuration between the first and second configuration is illustrated according to one embodiment. As illustrated, the support members 21 rotate about their pivotal connection (e.g. hinge 31) such that the splay angle between the desktop members 22 and the support members 21 is zero degrees or approximately zero degrees. In one embodiment, the support members 21 include one or more cutaways 52 to accommodate the hinge offsets 34 so that the support members can fold flat (e.g. zero degrees) and do not contact the hinge offsets 34. In one such embodiment, the hinge offsets 34 are elongated (not shown) to extend a distance perpendicular from the axis of the hinge joint. In one embodiment, the elongated hinge offsets in order to provide additional stiffening of the desktop members 22. For example, the hinge offsets 34 are extended perpendicular from the hinge joint a substantial distance across each desktop member 22 to create a support rib (not shown). In some embodiments, the hinge supports are elongated without increasing the thickness of the second configuration, because the elongated hinge supports nestle into the cutaways 52. The support members 32 are not visible because they are nestled or sandwiched between the support members 21 and the desktop members 22.

Referring to FIG. 5C, a bottom view of the second configuration is illustrated according to one embodiment. As illustrated, from the intermediary configuration to the second configuration, the support members 21 and desktop members 22 rotate about the joint (e.g. center hinges 33) such that the angle between the flanges of each center hinge 33 is zero degrees or approximately zero degrees. In one embodiment, the support members 21 and desktop members 22 are approximately rectangular in external outline, and the support members 21 and other components of the apparatus do not extend beyond the outline of the desktop members 22 providing a compact and portable profile. In one embodiment, the height of the hinge offsets 34 are such that the desktop members 22 are parallel or approximately parallel in the second configuration.

The foregoing description of the embodiments has been presented for the purposes of illustration and description. It is not intended to be exhaustive or to limit the present embodiments to the precise forms disclosed. Many modifications and variations are possible in light of the above teaching. It is intended that the scope of the present embodiments be limited not by this detailed description, but rather by the claims of this application. As will be understood by those familiar with the art, the present embodiments may take other specific forms without departing from the spirit or essential characteristics thereof. Likewise, the particular naming of the components, features, attributes and other aspects are not mandatory or significant, and may have different names. Accordingly, the disclosure is intended to be illustrative, but not limiting, of the scope, which is set forth in the following claims.

What is claimed is:

1. An apparatus with treadmill comprising:

a rigid first member;

a rigid second member;

a joint connecting a first end of the rigid first member to a first end of the rigid second member, the joint forming a connection, wherein the connection having at least two positions including a first position and a second position;

the first position aligning the rigid first member and the rigid second member into a first configuration for providing a work surface wherein a first surface of the rigid first member is coplanar to a first surface of the rigid second member to create the work surface for supporting a computing device and a user's wrists, the work surface rigid enough to support the computer device and the user's wrists;

the second position aligns the rigid first member and the rigid second member into a second configuration for transportation;

a first side-support member having a first end which is connected to a second end of the rigid first member by a first support hinge, the first side-support member extending from the work surface at a first splay angle between zero and one hundred and eighty degrees, wherein the first splay angle is zero in the second configuration and between ninety degrees and one hundred and eighty degrees in the first configuration, wherein the first side-support member is substantially coplanar to the rigid first member when the splay angle is substantially one hundred and eighty degrees in the first configuration; and a second side-support member having a first end which is connected to a second end of the rigid second member by a second support hinge, the second side-support member extending from the work surface at a second splay angle between zero and one hundred and eighty degrees, wherein the second splay angle is zero in the second configuration and between ninety degrees and one hundred and eighty degrees in the first configuration, wherein the second side-support member is substantially coplanar to the rigid second member when the second splay angle is substantially one hundred and eighty degrees in the first configuration, wherein one or more of the first and second splay angles in the first configuration are adjustable, a hinged side of the first and second side-support members each contacting a treadmill handrail and supporting the work surface.

2. The apparatus of claim 1, wherein the joint comprises a hinge connected to the rigid first member and the rigid second member opposite the first surfaces.

3. The apparatus of claim 2, wherein the hinge rotates between the second configuration at zero degrees and the first configuration at one hundred and eighty degrees.

4. The apparatus of claim 2 further comprising:

a first hinge offset at the first end of the rigid first member opposite the first surface connected to the hinge; and a second hinge offset at the first end of the rigid second member opposite the first surface connected to the hinge, the hinge offsets having a height for allowing the rigid first member to align parallel with the rigid second member in the second configuration.

5. The apparatus of claim 4, wherein one or both of the first hinge offset and the second hinge offset increasing the rigidity of one or both of the rigid first member and the rigid second member.

6. The apparatus of claim 1 further comprising:

an anti-slip surface on the apparatus at a contact point between the apparatus and a treadmill handrail for preventing the work surface from slipping relative to the treadmill handrail.

7. The apparatus of claim 1, wherein the first and second side-support members support the rigid first member and the rigid second member in the first configuration above the treadmill handrails.

8. The apparatus of claim 1 further comprising:

a means of adjusting one or more of the splay-angles of said side supports in the first configuration.

9. The apparatus of claim 1 wherein adjusting the splay angles in the first configuration adjusts the height of the work surface relative to the height of the treadmill handrails.

10. The apparatus of claim 1 wherein adjusting the splay angles in the first configuration adjusts the point of contact between the side supports and the treadmill handrail for accommodating different handrail spans.

11. The apparatus of claim 1 further comprising:

a flexible member attached to the first side-support member at a first end and the rigid first member at a second end and whose effective length is adjustable, the effective length determining the first splay-angle of the first side-support member in the first configuration.

12. The apparatus of claim 1 further comprising: tension element attached to the first side-support member at a first end of the tension element and the rigid second member at a second end of the tension element for adjusting the first side-support member to a selected first splay angle in the first configuration.

13. The apparatus of claim 1 further comprising:

a first flexible member attached to the first side-support member at a first end and the rigid first member at a second end and whose effective length is adjustable, the effective length determining and maintaining the first splay-angle of the first side-support member in the first configuration when the work surface is under load;

a second flexible member attached to the second side-support member at a first end and the rigid second member at a second end and whose effective length is adjustable, the effective length determining and maintaining the second splay-angle of the second side-support member in the first configuration when the work surface is under load.

14. The apparatus of claim 13 the first and second flexible members further comprising:

one or more indicators for determining the effective length of the first flexible member and first splay angle relative to the effective length of the second flexible member and second splay angle.

15. An apparatus for allowing a person to operate a computer while walking on a treadmill with handrails comprising:

a rigid first member;

a rigid second member;

a joint connecting a first end of the rigid first member to a first end of the rigid second member, the joint forming a connection, wherein the connection having at least two positions including a first position and a second position, the first position aligning the rigid first member and the rigid second member into a first configuration for providing a work surface wherein a first surface of the rigid first member is coplanar to a first surface of the second member to create the work surface for supporting a computing device and a user's wrists, the work surface rigid enough to support the computer device and the user's wrists;

the second position aligns the rigid first member and the rigid second member into a second configuration for transportation;

a first side-support member having a first end which is connected to a second end of the rigid first member by a first support hinge;

a second side-support member having a first end which is connected to a second end of the rigid second member by a second support hinge, the first and second side-supports each at opposite ends of the work surface and extending from the surface opposite the work surface at a splay angle between zero and one hundred and eighty degrees, wherein the splay angle is zero in the second configuration and between ninety degrees and one hundred and eighty degrees in the first configuration, the first and second side-support members substantially coplanar to the rigid first member and the rigid second member in the first configuration when the splay angle is substantially one hundred and eighty degrees, wherein the splay angle in the first configuration is adjustable, a hinged side of the first and second side-support members are each configured to contact a treadmill handrail and for supporting the work surface;

a first hinge offset at the first end of the rigid first member opposite the first surface connected to the hinge; and a second hinge offset at the first end of the rigid second member opposite the first surface connected to the hinge, the hinge offsets having a height that aligns the rigid first member and rigid second member substantially parallel to each other in the second configuration with the first and second side supports nested between the first member and the rigid second member at a zero degree splay angle.

16. The apparatus of claim 1, wherein the first and second splay angles are individually adjustable.

* * * * *